US006854408B2

(12) United States Patent
De Baan

(10) Patent No.: US 6,854,408 B2
(45) Date of Patent: Feb. 15, 2005

(54) APPARATUS FOR MOORING VESSELS SIDE-BY-SIDE

(75) Inventor: Jacob De Baan, Maassluis (NL)

(73) Assignee: Bluewater Energy Services BV (NL)

( * ) Notice: Subject to any disclaimer, the term of this patent is extended or adjusted under 35 U.S.C. 154(b) by 0 days.

(21) Appl. No.: 10/691,323

(22) Filed: Oct. 22, 2003

(65) Prior Publication Data

US 2004/0129195 A1 Jul. 8, 2004

(30) Foreign Application Priority Data

Oct. 24, 2002 (GB) ..... 0224784

(51) Int. Cl.[7] ..... B63B 21/00
(52) U.S. Cl. ..... 114/230.19
(58) Field of Search ..... 114/230.1, 230.11, 114/230.18, 230.19, 230.2, 230.22

(56) References Cited

U.S. PATENT DOCUMENTS

| | | | | |
|---|---|---|---|---|
| 4,169,423 A | * | 10/1979 | Laskey | 114/248 |
| 4,250,827 A | * | 2/1981 | Booker et al. | 114/230.18 |
| 4,280,440 A | * | 7/1981 | Barton | 114/230.11 |
| 5,154,132 A | * | 10/1992 | Brushaber | 114/230.11 |
| 5,499,591 A | | 3/1996 | Chippas | |
| 5,501,625 A | | 3/1996 | Belinsky | |
| 6,227,135 B1 | | 5/2001 | Pedersen | |
| 2001/0029878 A1 | | 10/2001 | Seaman et al. | |

FOREIGN PATENT DOCUMENTS

| | | |
|---|---|---|
| EP | 0104122 A | 3/1984 |
| FR | 2795041 | 6/1999 |

* cited by examiner

*Primary Examiner*—Stephen Avila
(74) *Attorney, Agent, or Firm*—Fulwider Patton Lee & Utecht, LLP

(57) ABSTRACT

An apparatus as described for mooring to floating vessels (10, 12) side-by-side. The first vessel (10) is moored to the seabed by a single point mooring system (14). The apparatus comprises an arm (20) with proximal and distal ends. The arm (20) is mountable on the first vessel (10) for rotation about a vertical axis and the distal end projects outwardly from the first vessel (10) in use. A substantially inelastic mooring line (24) is attached to the distal end of the arm (20) and is securable to the second vessel (12). The resilient means (26, 28) is operable to allow limited rotation of the arm (20) about the axis in the first direction in response to tension in the mooring line (24) which exceeds a predetermined value. The resilient means automatically restores the arm (20) to its former position upon reduction of the tension below the predetermined value. The arm (20) is freely rotatable about the axis in a second direction opposite to the first direction.

20 Claims, 3 Drawing Sheets

APPARATUS FOR MOORING VESSELS SIDE-BY-SIDE

The present invention relates to apparatus for mooring two vessels side-by-side at an offshore location.

When it is necessary to moor two vessels together offshore, two methods are commonly used in the industry. The first is side-by-side mooring and the second is stern-to-bow mooring, often referred to as tandem mooring. Each of these methods has its particular application, with tandem mooring being applied when the sea conditions are too high for side-by-side mooring.

Traditionally, with side-by-side mooring systems, both vessels are more or less tightly pulled together with their sides against each other, separated only by floating fenders, typically of air or foam filled rubber. A common problem is that very often the vessels tend to roll as dictated by each vessel's exposure to the waves. In some cases, the roll of the two vessels will not be synchronized and the potential for damage exists. In addition, the fenders and mooring lines are worked to their limits. Since side-by-side mooring typically employs eight to ten mooring lines between the two vessels, arranged over the length of the vessels, a significant hazard to the operational staff is also present. Moreover, the procedure to establish side-by-side mooring is time consuming.

The present invention provides apparatus for mooring first and second floating vessels side-by-side, the first vessel being moored to the seabed by a single point mooring systems, the apparatus comprising an arm having a proximal end and a distal end, the arm being mountable on the first vessel for rotation about a vertical axis and with the distal end projecting outwardly from the first vessel in use, a substantially inelastic mooring line attached to the distal end of the arm and securable to the second vessel in use, resilient means operable to allow limited rotation of the arm about the axis in a first direction in response to tension on the mooring line which exceeds a predetermined value and to automatically restore the arm to its former position upon reduction of the tension below the predetermined value, and wherein the arm is freely rotatable about the axis in a second direction opposite to the first direction.

Preferably, the resilient means comprises a piston and cylinder mountable to the first vessel adjacent the arm such that rotation of the arm in the first direction brings the arm into contact with the piston and to compress the piston into cylinder when the tension on the mooring line exceeds the predetermined value, and wherein the cylinder is operable to extend the piston upon reduction of the tension below the predetermined value.

Alternatively, the resilient means may comprise a stop member mountable on the first vessel such that rotation of the arm in the first direction brings the arm into contact with the stop member, and a piston and cylinder mounted on the distal end of the arm between the arm and the mooring line and operable to extend when the tension on the mooring line exceeds the predetermined value, and to retract upon reduction of the tension below the predetermined value.

The arm is preferably mountable on the first vessel at a location towards the bow.

A fender means is preferably mountable on the first vessel on the same side as the arm and located approximately two thirds of the way towards the stern.

A loading means for transferring fluid between the first vessel and a second vessel moored side-by-side is preferably mountable on the first vessel at a location between the arm and the fender means.

The loading means may include catenary hoses or rigid piping.

The arm is preferably dimensioned such that in use the separation between the first and second vessels is approximately one vessel's width.

Conveniently, the mooring line comprises a hawser.

The apparatus may advantageously be used with a second vessel having lateral thrust producing means located in its stern region, in which case the apparatus further comprises a second mooring line attachable in the stern region of the first vessel and securable to the stern region of the second vessel.

In another aspect, the invention also provides a floating vessel incorporating apparatus as described above for mooring the vessel to a second vessel.

In this case, the floating vessel preferably further comprises lateral thrust producing devices in the stern region of the first vessel.

The first vessel preferably also includes a single point mooring system attached to the bow region and lateral thrust producing means located in the stern region.

The invention will now be described in detail, by way of example only, with reference to the accompanying drawings in which.

Figure 1:
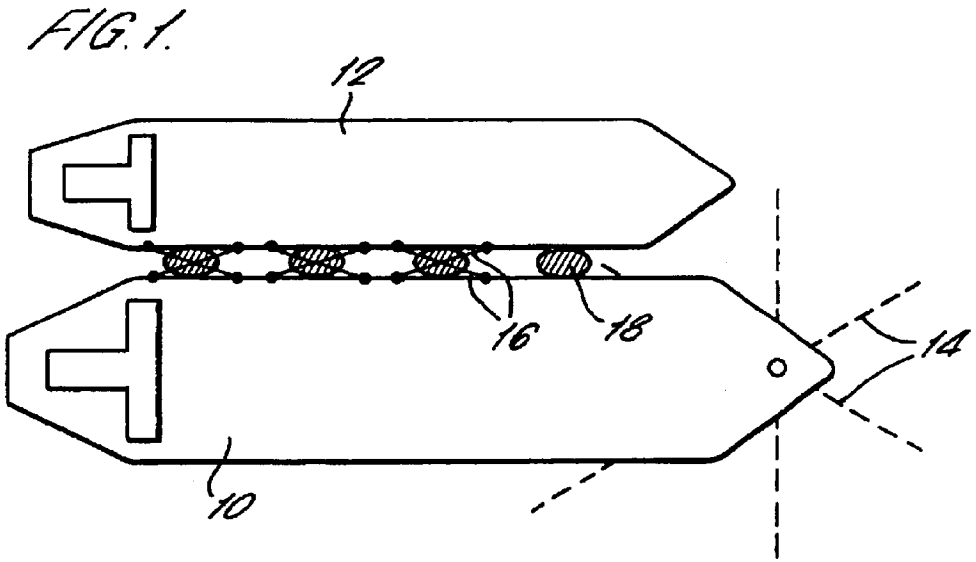
FIG. 1 is a plan view of a conventional side-by-side mooring.

FIG. 1 shows a conventional side-by-side mooring system for two vessels 10, 12. The first vessel 10 is typically permanently moored at an offshore location, for example by a single point mooring system 14 at the bow, as is well known in the art. A plurality of mooring lines 16 are arranged in a crossed fashion to moor a visiting second vessel 12 to the first vessel 10. A number of fenders 18 are located between the vessels 10, 12.

Figure 2:
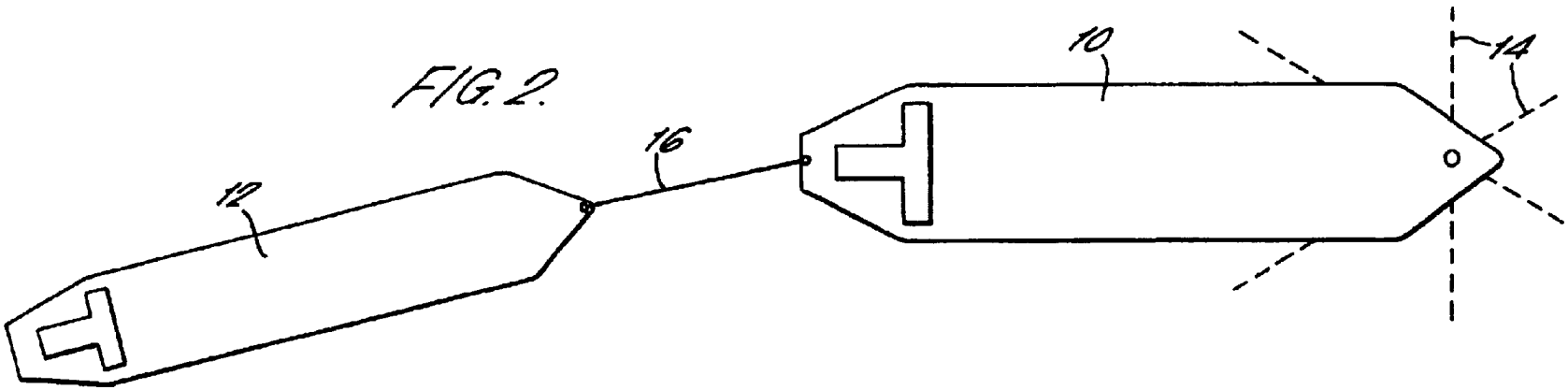
FIG. 2 is a plan view of a conventional tandem mooring.

FIG. 2 shows a conventional tandem mooring system in which the first vessel 10, with the single point mooring 14 at its bow, is moored by a line 16 from its stern to the bow of the visiting vessel 12.

Figure 3:
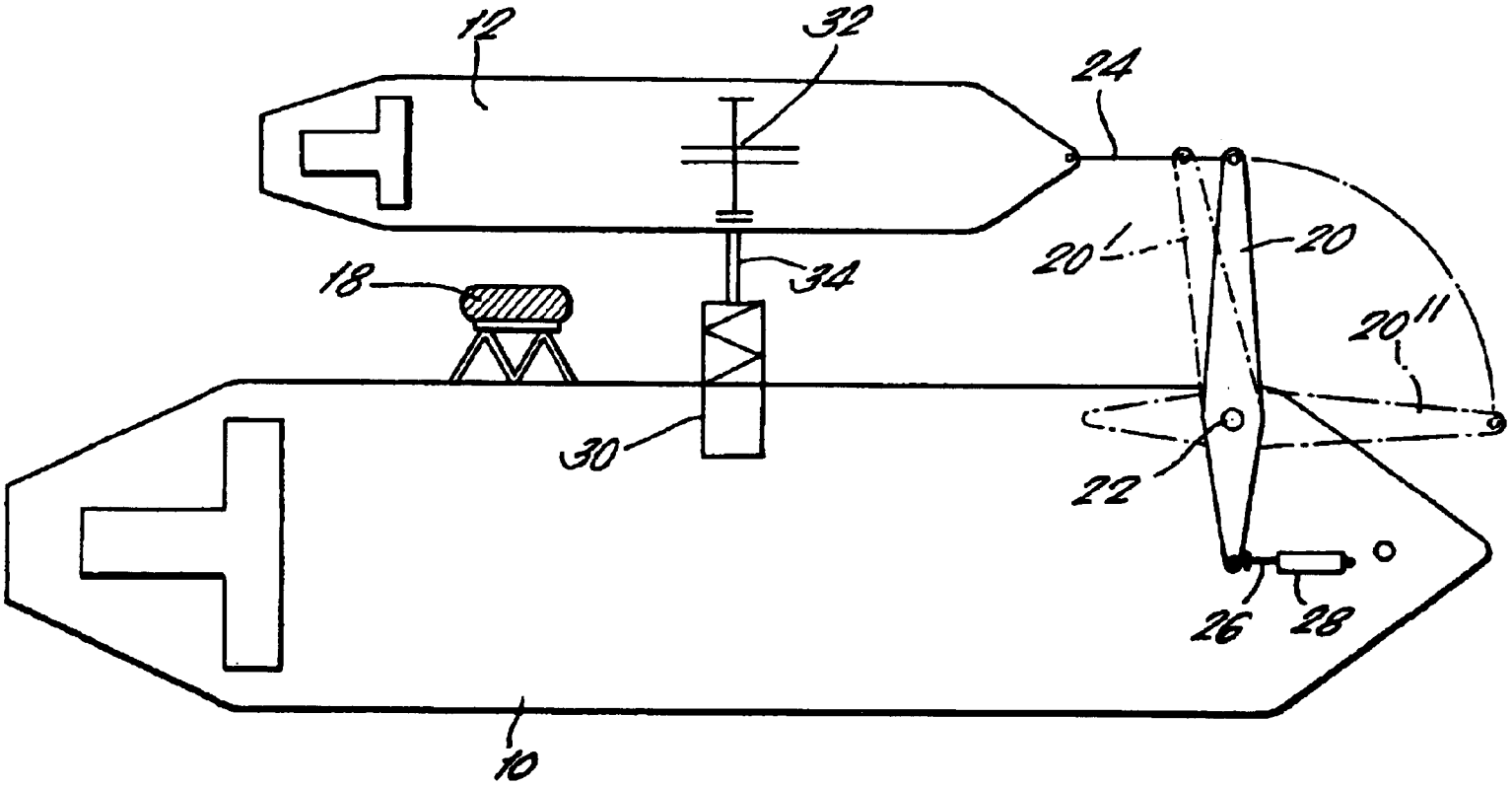
FIG. 3 is a plan view of a first embodiment of apparatus for side-by-side mooring in accordance with the present invention.

FIG. 3 shows a first embodiment of the present invention, using the same reference numerals as above where appropriate. In this case, the first vessel 10 carries a mooring arm 20 mounted on the vessel at a pivot 22 for rotation about a substantially vertical axis. The arm 20 is located towards the bow region of the vessel 10. A fender arrangement 18 is secured to the vessel 10, preferably at about two-thirds of the length of the vessel aft of the bow, on the same side as the mounting mooring arm 20.

In use, the mooring arm 20 projects laterally outwardly from the vessel 10. A substantially inelastic mooring line, typically a hawser 24 made from plastic fibers, is secured to the distal end of the arm 20, and in use is moored to the bow of the visiting vessel 12. The hawser 24 is designed to be relatively short so that lateral movements of the bow of the visiting vessel 12 are restricted. Additionally, it is designed with low elasticity such that it does not have sufficient elasticity to allow the visiting vessel 12 to go through its natural motions in the horizontal plane along the longitudinal axis of the visiting vessel 12.

The mooring arm 20 extends proximally of the pivot 22 over the deck of the vessel 10. As described further below, a piston 26, which is reciprocatable in a hydraulic oil/gas cylinder 28 secured to the vessel 10, is located adjacent the proximal end of the arm 20.

If the action of wind and waves causes the visiting vessel 12 to move away from the arm 20 towards the left-hand side in FIG. 3 this will pull on the distal end of the arm 20 and tend to rotate it anticlockwise as seen in FIG. 3. This will cause the proximal end of the arm 20 to push against the piston 26. When the tension on the hawser 24 and thus the load on the arm 20 exceeds a predetermined value, the cylinder 28 yields and allows the piston 26 to be pushed in. This in turn allows the arm 20 to rotate anti-clockwise as viewed in FIG. 3 to the position indicated by the dotted lines 20'. When the load on the hawser 24 subsides, the piston 26 extends out of the cylinder 28 and rotates the arm 20 clockwise in FIG. 3 to resume its original position.

If, on the other hand, the visiting vessel 12 moves towards the arm 20 and the right-hand side of FIG. 3, the arm 20 would present an obstacle and risk damage. To avoid this problem, the proximal end of the arm 20 is not connected to the piston 26 or the cylinder 28. Therefore, the arm 20 can rotate freely clockwise as viewed in FIG. 3 to the position shown in dotted lines 20". Thus, if the visiting vessel 12 rides right up to the arm 20, it will simply push the arm out of the way.

In this way, the piston 26 and cylinder 28 effectively act to give some degree of elasticity to the hawser 24 if it is placed in tension above a certain level, to provide an "elastic" stroke as shown in FIG. 3. This effect can also be achieved in other ways. For example, a stop member could be located on the deck of a vessel 10 adjacent to the proximal end of the arm 20, with which the arm 20 makes contact if it rotates anticlockwise. A piston and cylinder arrangement could then be provided at the distal end of the arm 20, between the arm 20 and the hawser 24, which extends when the load on the hawser 24 exceeds the given value and contracts when the load subsides.

The mooring arm 20 and hawser 24 are typically dimensioned such that the visiting vessel 12 is moored at about one vessel's width away from the first vessel 10. The fender 18 prevents the vessels 10, 12 contacting each other if relative yaw motions occur between them.

Loading means 30 is fitted to the first vessel 10 at a location to coincide with the midship loading manifolds 32 of the second vessel 12. Due to the relatively large gap between the two vessels 10, 12, catenary hoses 34 may be used to advantage to connect the loading means 30 to the manifolds 32, particularly if cryogenic products are to be transferred. However, traditional rigid piping transfer systems may also be employed.

Figure 4:
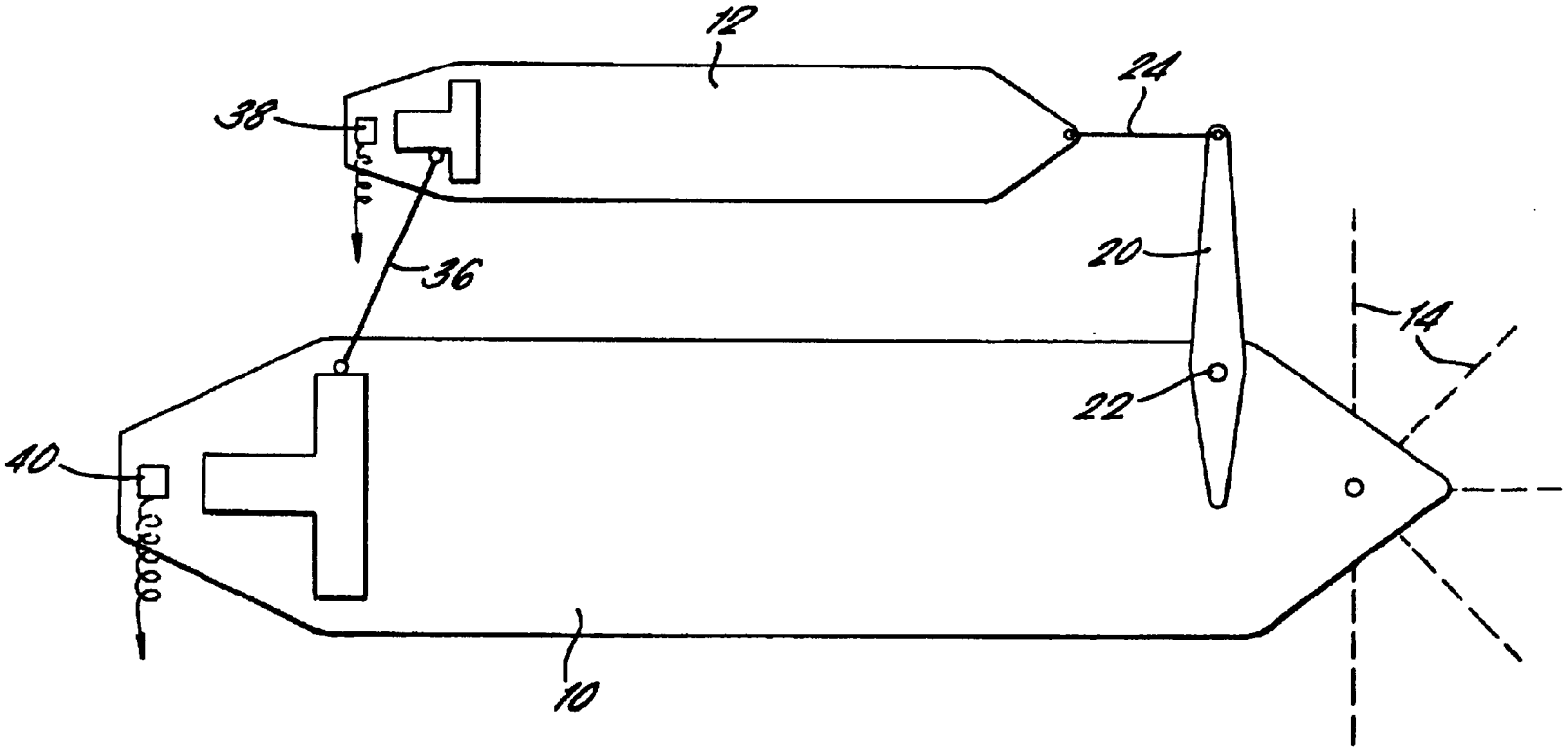
FIG. 4 is a plan view of a second embodiment of apparatus for side-by-side mooring system in accordance with the present invention.

FIG. 4 illustrates an alternative embodiment of the present invention. As in FIG. 3, the first vessel 10 includes a rotatably mounted mooring arm 20 and hawser 24 for mooring to the bow of a visiting vessel 12. Although not shown in FIG. 4, the piston 26, cylinder 28, fender 18 and loading means 30 as in FIG. 3 may also be present. In addition, a second hawser 36 is attached towards the stern of the first vessel 10 and secured in use to the visiting vessel 12, also towards its stern. Advantageously, the visiting vessel 12 is fitted with some form of side propulsion means 38 which acts to produce thrust laterally, at the stern end. This can be activated to maintain the second hawser 36 taut between the two vessels 10,12 so that the visiting vessel 12 will not contact any fender system 18 but also not drift away from the first vessel 10.

A further improvement to the overall system can be achieved if the first vessel 10 is also provided with a single point mooring system 14 at the bow and transversely acting thrust producing devices 40 at the stern. These can be used to rotate the first vessel 10 about the single point mooring 14 to optimise its overall heading such that a situation of least relative movement is obtained. This is more efficient and safe and minimises the loads placed upon the mooring system and transfer equipment.

Thus, the present invention provides an improved apparatus for side-by-side mooring of two vessels which is safer and more efficient than known systems.

What is claimed is:

1. Apparatus for mooring first and second floating vessels side-by-side, the first vessel being moored to the seabed by a single point mooring system, the apparatus comprising an arm having a proximal end and a distal end, the arm being mountable on the first vessel for rotation about a vertical axis and with the distal end projecting outwardly from the first vessel in use, a substantially inelastic mooring line attached to the distal end of the arm and securable to the second vessel in use, resilient means operable to allow limited rotation of the arm about the axis in a first direction in response to tension on the mooring line which exceeds a predetermined value and to automatically restore the arm to its former position upon reduction of the tension below the predetermined value, and wherein the arm is freely rotatable about the axis in a second direction opposite to the first direction.

2. Apparatus as claimed in claim 1, wherein the resilient means comprises a piston and cylinder mountable to the first vessel adjacent the arm such that rotation of the arm in the first direction brings the arm into contact with the piston and to compress the piston into the cylinder when the tension on the mooring line exceeds the predetermined value, and wherein the cylinder is operable to extend the piston upon reduction of the tension below the predetermined value.

3. Apparatus as claimed in claim 1, wherein the resilient means comprises a stop member mountable on the first vessel such that rotation of the arm in the first direction brings the arm into contact with the stop member and a piston and cylinder mounted on the distal end of the arm between the arm and the mooring line and operable to extend when the tension on the mooring line exceeds the predetermined value, and to retract upon reduction of the tension below the predetermined value.

4. Apparatus as claimed in claim 1, wherein the arm is mountable on the first vessel at a location towards the bow.

5. Apparatus as claimed in claim 1, wherein the arm is dimensioned such that in use the separation of the first and second vessels is approximately equal to one vessel's width.

6. Apparatus as claimed in claim 1, wherein the mooring line comprises a hawser.

7. Apparatus as claimed in claim 1, for use with a second vessel having lateral thrust producing means located at its stern, the apparatus further comprising a second mooring line attachable in a stern region of the first vessel and securable to the stern region of the second vessel.

8. Apparatus as claimed in claim 4, further comprising fender means mountable on the first vessel on the same side as the arm and located approximately two thirds of the way towards the stern.

9. Apparatus as claimed in claim 8, further comprising loading means for transferring fluid between the first and second vessels, mountable on the first vessel between the arm and the fender means.

10. Apparatus as claimed in claim 9, wherein the loading means includes catenary hoses.

11. Apparatus as claimed in claim 9, wherein the loading 10 means includes rigid piping.

12. A floating vessel as claimed in claim 1, further comprising lateral thrust producing devices in the stern region of the first vessel.

13. A floating vessel as claimed in claim 2, further comprising lateral thrust producing devices in the stern region of the first vessel.

14. A floating vessel as claimed in claim 3, further comprising lateral thrust producing devices in the stern region of the first vessel.

15. A floating vessel as claimed in claim 4, further comprising lateral thrust producing devices in the stern region of the first vessel.

16. A floating vessel as claimed in claim 5, further comprising lateral thrust producing devices in the stern region of the first vessel.

17. A floating vessel as claimed in claim 6, further comprising lateral thrust producing devices in the stern region of the first vessel.

18. A floating vessel as claimed in claim 7, further comprising lateral thrust producing devices in the stern region of the first vessel.

19. A floating vessel as claimed in claim 8, further comprising lateral thrust producing devices in the stern region of the first vessel.

20. A floating vessel as claimed in claim 9, further comprising lateral thrust producing devices in the stern region of the first vessel.

* * * * *